US010625271B2

(12) United States Patent
Browning

(10) Patent No.: US 10,625,271 B2
(45) Date of Patent: Apr. 21, 2020

(54) METHOD AND APPARATUS FOR CONCRETE WASHOUT

(71) Applicant: Casey Browning, Fredericksburg, VA (US)

(72) Inventor: Casey Browning, Fredericksburg, VA (US)

( * ) Notice: Subject to any disclaimer, the term of this patent is extended or adjusted under 35 U.S.C. 154(b) by 44 days.

(21) Appl. No.: 15/932,913

(22) Filed: May 21, 2018

(65) Prior Publication Data

US 2019/0351430 A1 Nov. 21, 2019

(51) Int. Cl.

| | |
|---|---|
| ***B03B 9/06*** | (2006.01) |
| ***B28C 7/16*** | (2006.01) |
| ***B08B 17/02*** | (2006.01) |
| ***B28C 5/42*** | (2006.01) |

(52) U.S. Cl.

CPC ..... *B03B 9/063* (2013.01); *B08B 17/025* (2013.01); *B28C 5/4203* (2013.01); *B28C 7/16* (2013.01)

(58) Field of Classification Search

CPC ..... B08B 17/025; B08B 3/04; B03B 9/063; B03B 9/06; B28C 5/4203; B28C 7/16

USPC ..... 220/752

See application file for complete search history.

(56) References Cited

U.S. PATENT DOCUMENTS 5,460,431 A * 10/1995 McWilliams ..... B60P 1/16 298/17 B

2009/0045193 A1* 2/2009 Jenkins ..... B08B 17/00 220/23.87

* cited by examiner

*Primary Examiner* — King M Chu

(74) *Attorney, Agent, or Firm* — Thomas J. Wallen, P.E. Attorney at Law, L.L.C.; Eugene H. Eickholt

(57) ABSTRACT

A container for receiving and transporting residual washout concrete or cement from concrete handling apparatus comprising a rectangular top frame member including two lateral top frame members and two transverse top frame members, the top frame members affixed at their distal ends thereby forming the rectangular top frame member, and a rectangular bottom frame member including two lateral bottom frame members and two transverse bottom frame members, the bottom frame members affixed at their distal ends thereby forming the rectangular bottom frame member, wherein the top and bottom frame members are oriented in substantial parallel planes, and including rigid side frame members affixed to both the top frame member and the bottom frame member, thereby maintaining the substantial parallel relationship between the top and bottom frame members, further including side plate members affixed to the side frame members, and a bottom plate member affixed to the bottom frame members, the side and bottom plate members together with the top, bottom, and side frame members forming a concrete or cement tight container.

8 Claims, 2 Drawing Sheets

METHOD AND APPARATUS FOR CONCRETE WASHOUT

FIELD OF THE INVENTION

The present invention is directed to a method and apparatus for washing residual concrete or cement from concrete handling equipment such as concrete pumps and cement mixers.

BACKGROUND OF THE INVENTION

Federal and state environmental regulations mandate that concrete washed from concrete pumps and concrete mixers must be contained for safe disposal. The chutes and hoppers must have residual concrete cleaned and removed from the surfaces upon which the concrete adheres to prevent the residual concrete from hardening within the equipment thereby damaging the equipment. Additionally, washed out concrete cannot be haphazardly disposed of into the environment. Therefore there exists a need for a concrete containment apparatus and method that efficiently isolates the residual concrete from concrete hoppers and mixers, including concrete trucks used in the delivery of concrete.

The use of hay bales and plastic to isolate washout concrete is well known. A perimeter of hay bales with or without a plastic film liner is provided, creating a volume within which washout concrete is poured, preventing the washout concrete from escaping into the environment. Once the concrete dries, it can be removed and properly disposed. However, the variability in height of hay bales creates difficulty in appropriately locating a concrete mixer such that the washout concrete chute properly overlies the volume within which the washout concrete is to be poured. Ramps have been combined with the hay bales to orient the concrete pumping apparatus but again the relative positions of the concrete pumping apparatus and the height of the ramps is unacceptably variant.

Containers for washout concrete are known, however the containers are not sized to efficiently underlie the concrete pump. Frequently the rear end of the concrete pumping apparatus will be too low and the container will interfere with the concrete pump. In order to compensate, the concrete mixer is backed onto ramps to raise the concrete pump above the washout containment container. This creates yet another problem because the inherent weight of the concrete mixing machinery frequently exceeds 60,000-80,000 pounds. As a result many concrete companies do not allow the use of ramps.

SUMMARY OF THE INVENTION

A container is disclosed that is specifically designed to interface with common concrete handling apparatus, which readily isolates and safely stores residual concrete for disposal. The container is specifically adapted to interface with conventional cement mixers. However, the container can be used to isolate washout residual concrete or cement from any concrete pump or concrete handling device.

DETAILED DESCRIPTION OF PREFERRED EMBODIMENTS

Figure 1:
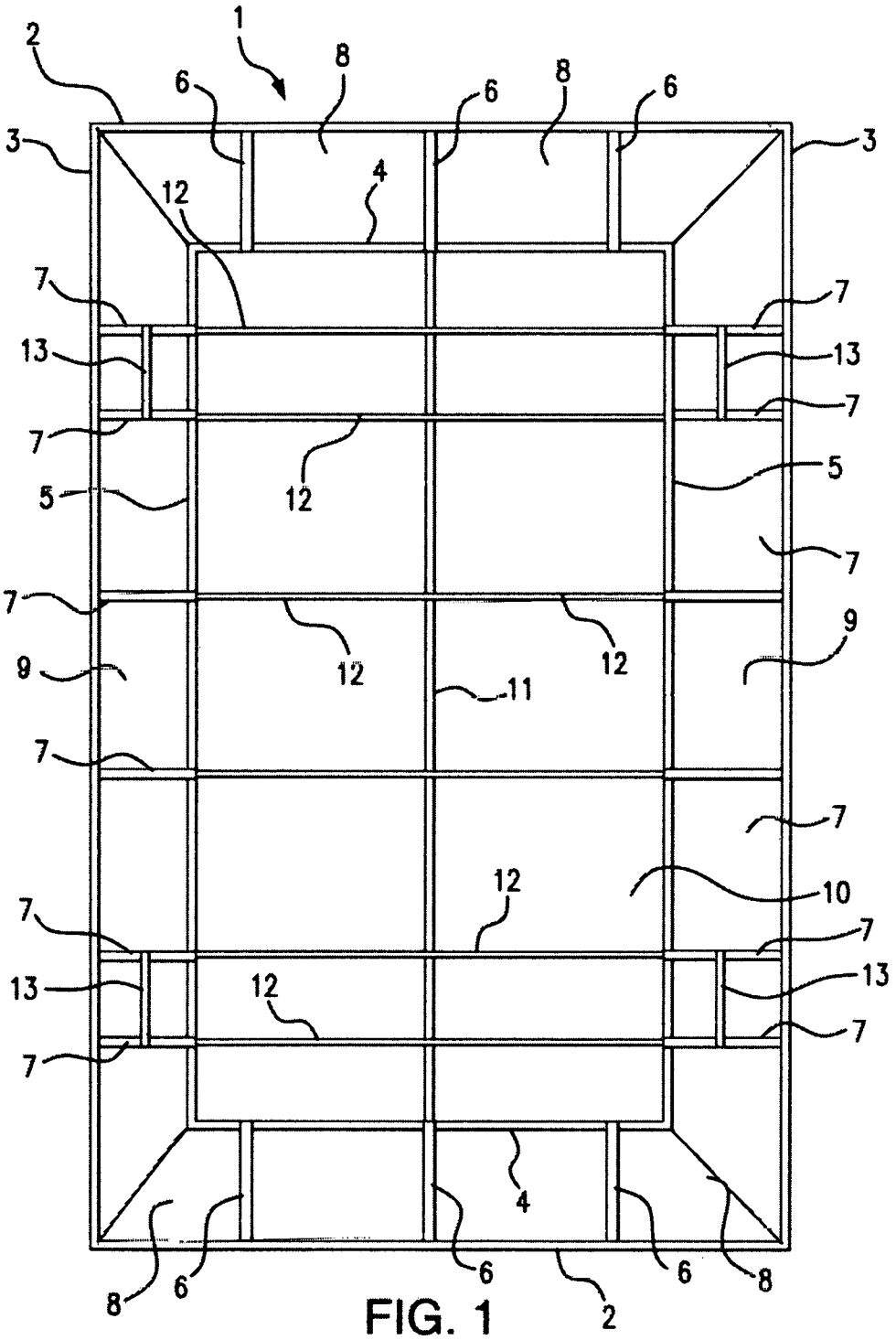
FIG. 1 shows a concrete washout container according to the invention. The container is specifically sized to underlie a concrete pump of a concrete mixer without the use of a ramps.
Figure 2:
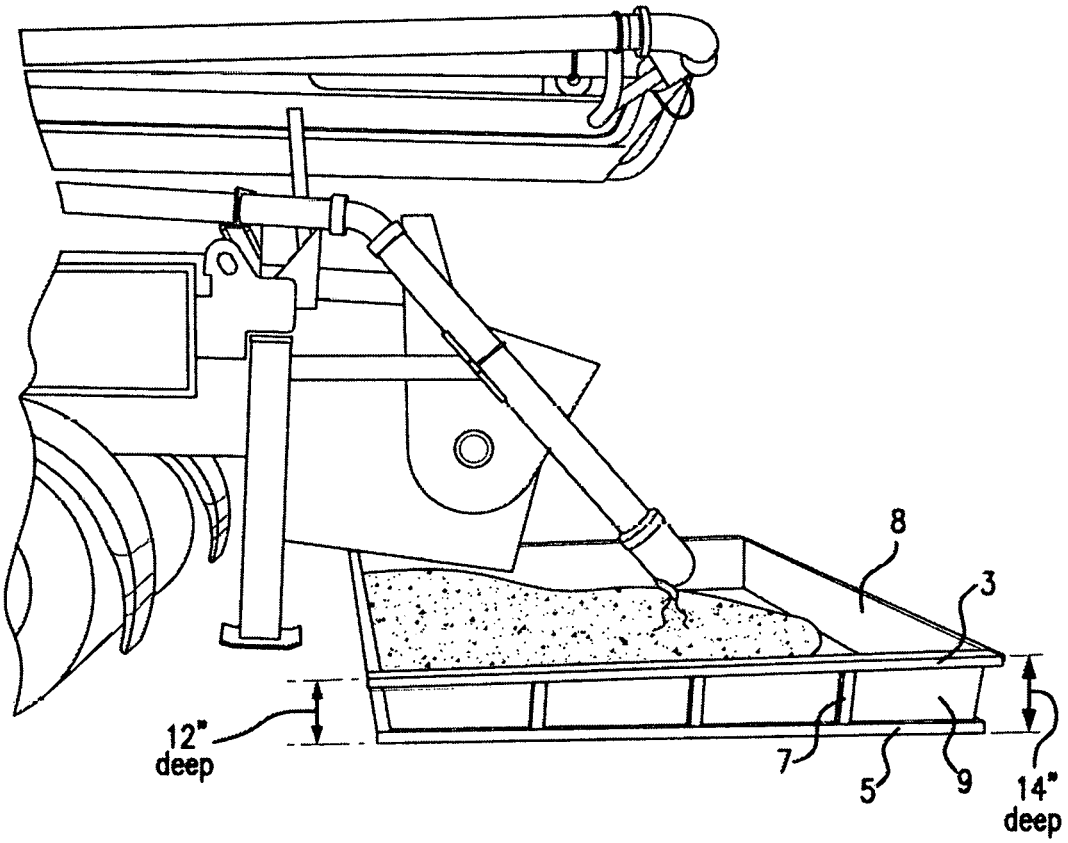
FIG. 2 shows the concrete container of FIG. 1 being filled with washout concrete from a cement mixer.

Referring to FIG. 1, the present invention comprises a container (1) intended to isolate washout concrete for later disposal. The top of container (1) is constructed with two top lateral frame members (2), each of the two top lateral frame members (2) having a proximal and distal end, and two top transverse frame members (3), each of the two top transverse frame members (3) having a proximal and distal end, where the proximal and distal ends of the lateral and transverse top frame members (2) and (3) combine to form a rectangular rigid top frame. The two lateral top frame members (2) and two transverse top frame members (3) are welded or otherwise permanently affixed to each other at their terminal ends to form a rectangular top peripheral frame of the concrete containment apparatus.

The bottom of container (1) is constructed with two bottom lateral frame members (4), each of the two bottom lateral frame members (4) having a proximal and distal end, and two bottom transverse frame members (5), each of the two bottom transverse frame members (5) having a proximal and distal end, where the proximal and distal ends of the lateral and transverse bottom frame members (4) and (5) combine to form a rectangular rigid bottom frame. The two lateral bottom frame members (4) and two transverse bottom frame members (5) are welded or otherwise permanently affixed to each other at their terminal ends to form a rectangular bottom peripheral frame of the concrete containment apparatus.

The rigid top frame and rigid bottom frame are secured together in parallel or non-parallel plane orientation utilizing side rib members. Top lateral frame members (2) are permanently affixed to bottom lateral frame members (4) with lateral side rib members (6). Lateral side rib members (6) are welded or otherwise permanently affixed to both lateral top frame members (2) and bottom lateral frame members (4). Similarly, top transverse frame members (3) are permanently affixed to bottom transverse frame members (5) with transverse side rib members (7). Transverse side rib members (7) are welded or otherwise permanently affixed to both transverse top frame members (3) and bottom transverse frame members (5). It is expressly understood that the invention contemplates the usage of any number of side rib members (6) or (7), which number is largely determined by the desired strength necessary for container (1).

The top and bottom frame members are permanently and rigidly secured in a parallel or non-parallel plane configuration by the transverse and lateral side rib members (6) and (7). In order to construct a concrete or cement tight container two lateral side panels (8) are welded or otherwise permanently affixed to both lateral top and lateral bottom frame members (2) and (4) as well as lateral side ribs (6). Likewise, two transverse side panels (9) are welded or otherwise permanently affixed to transverse top and bottom transverse frame members (3) and (5) as well as transverse side rib members (7). Further a bottom panel member (10) is welded or otherwise permanently affixed to the bottom frame comprising the two bottom lateral frame members (4) and the two bottom transverse frame members (5). Lateral side-panels (8) can also be welded to transverse side panels (9) at the four corners where lateral side panels (8) intersect transverse side panels (9). In this fashion, the top and bottom frame members together with the side panels and bottom panel form a containment volume within which washout concrete or cement can be poured and isolated from the environment. Because concrete or cement is poured into the container, the top frame usually is not covered by a panel thereby allowing concrete or cement to be poured into the container from above. However it is expressly understood that only a portion of the top of the container need be open, so long as washed out concrete can be poured into the container.

To further strengthen the container (1), the container (1) is provided with transverse cross-bar members (11). Transverse cross-bar members (11) are welded or otherwise rigidly affixed to both lateral bottom frame members (4) and lateral side rib members (6). Transverse cross-bar members (11) are preferably also welded or otherwise permanently affixed to bottom plate member (10). In this manner the concrete washout container (1) is extremely strong and resists deformation from the weight of washout concrete and is particularly strong in torsion. It is expressly understood that container (1) can be provided with any number of cross-bar members (11) in order to achieve the required strength.

Similarly, the container (1) is provided with lateral cross-bar members (12). Lateral cross-bar members (12) are welded or otherwise rigidly affixed to transverse side rib members (7). Lateral cross-bar members (12) are preferably also welded or otherwise permanently affixed to bottom plate member (10). In this manner the concrete or cement washout container (1) is extremely strong and resists deformation from the weight of washout concrete or cement and is particularly strong in torsion. It is expressly understood that container (1) can be provided with any number of lateral cross-bar members (12) in order to achieve the required strength.

Lifting bars (13) are welded or otherwise permanently affixed between two lateral side rib members (6) at each of the four corners. The purpose of the lifting bars (13) is to provide a secure surface to attach suitable lifting apparatus capable of lifting and relocating container (1) when container (1) is filled with washout concrete or cement.

Critical to the practice of the invention is the exact height of container (1). When the height of container (1) is appropriate a concrete mixer can overlie container (1) without the use of ramps. This is not only more practical by avoiding pitfalls inherent in backing a concrete mixer onto ramps, but also eliminates the dangers associated with collapsing ramps due to the extreme weight of the concrete handling apparatus. The following dimensions have proven to be particularly suitable for a container where the top and bottom frames are non-parallel.

| | |
|---|---|
| Top lateral frame members (2) | 10'4" |
| Top transverse frame members (3) | 8'4" |
| Bottom lateral frame members (4) | 10'0" |
| Bottom transverse frame members (5) | 8'0" |
| Depth between top frame and bottom frame, back side | 14" |
| Depth between top frame and bottom frame, back side, front side | 12" |

Utilizing these dimensions container (1) holds up to 2.71 yards of concrete and readily rests below the chute of a conventional concrete mixer. It is particularly important to the practice of the invention that the depth of the container taper from 14" on the front side to 12" on the back side. By tapering the depth of the container a concrete or cement handling apparatus directly overlies container (1) without the use of ramps. While the maximum practical height of the back side is 12", the front side can of course exceed 12" and still fit below the chute of a concrete mixer.

In another embodiment designed to hold up to 1.48 yards of concrete, the top frame and bottom frame are in a parallel plane configuration, wherein the front and back of the container are of equal depth. The following dimensions have proved to be appropriate.

| | |
|---|---|
| Top lateral frame members (2) | 18'4" |
| Top transverse frame members (3) | 6'4" |
| Bottom lateral frame members (4) | 18'0" |
| Bottom transverse frame members (5) | 6'0" |
| Depth between top frame and bottom frame | 12" |

Steel plate at least 3/16" thick has proven suitable for the side and bottom surfaces, although it is expressly understood that the invention is not limited to the plate thickness. Square tubing 2" square has proven most suitable for the top and bottom frame members and side rib members. Solid ¾" round cold rolled steel suffices for the lifting bars.

In use the container (1) is placed directly on the ground or other solid surface capable of supporting a concrete mixing truck or concrete handling apparatus. Because the depth of container (1) is dimensioned to fit under the concrete chute of the concrete handling apparatus, there is no need to back onto ramps. The chute from the concrete handling apparatus directly overlies container (1). Residual concrete is then washed out into container (1). Container (1) is next lifted onto a removal apparatus such as a flat bed truck and finally transported to a suitable disposal site.

The invention claimed is:

1. A container for receiving and transporting residual washout concrete or cement from concrete or cement handling apparatus comprising a rectangular top frame including two lateral top frame members each having a distal and proximal end, and two transverse top frame members each having a distal and proximal end, the two top lateral frame members and two top transverse frame members affixed at their distal and proximal ends such that they form the rectangular top frame, and a rectangular bottom frame including two lateral bottom frame members each having a distal and proximal end and two transverse bottom frame members each having a distal and proximal end, the two lateral bottom frame members affixed at their distal and proximal ends to the two transverse bottom frame members at their distal and proximal ends such that they form the rectangular bottom frame, and including rigid side frame members affixed to both the top frame and the bottom frame, wherein the top and bottom frames are oriented in substantial parallel planes, further including side plate members affixed to the side frame members, and a bottom plate member affixed to the bottom frame, the side and bottom plate members together with the top frame, the bottom frame, and the side frame members forming a concrete or cement tight container further including lifting bars affixed to the side frame members of the container enabling the container to be lifted and removed to a suitable waste disposal site.

2. The cement or concrete container of claim 1 wherein the maximum depth of the container is adapted to fit beneath the chute of a concrete mixer or other concrete handling apparatus.

3. The cement or concrete container of claim 2 wherein the container depth is a maximum of 12 inches.

4. The cement or concrete container of claim 2 wherein the container depth is a maximum of 14 inches.

5. A container for receiving and transporting residual washout concrete or cement from concrete or cement handling apparatus comprising a rectangular top frame including two lateral top frame members each having a distal and proximal end, and two transverse top frame members each having a distal and proximal end, the two top lateral frame members and two top transverse frame members affixed at their distal and proximal ends such that they form the rectangular top frame, and a rectangular bottom frame including two lateral bottom frame members each having a distal and proximal end and two transverse bottom frame members each having a distal and proximal end, the two lateral bottom frame members affixed at their distal and proximal ends to the two transverse bottom frame members at their distal and proximal ends such that they form the rectangular bottom frame, and including rigid side frame members affixed to both the top frame and the bottom frame, wherein the top and bottom frames are oriented in substantial non-parallel planes, the side frame members maintaining the substantial non-parallel relationship between the top and bottom frames, further including side plate members affixed to the side frame members, and a bottom plate member affixed to the bottom frame, the side and bottom plate members together with the top frame, the bottom frame, and the side frame members forming a concrete or cement tight container further including lifting bars affixed to the side frame members of the container enabling the container to be lifted and removed to a suitable waste disposal site.

6. The cement or concrete container of claim 5 wherein the maximum depth of the container is adapted to fit beneath the chute of a concrete mixer or other concrete handling apparatus.

7. The cement or concrete container of claim 6 wherein the container depth is a maximum of 12 inches at one transverse end and 14 inches at the opposite transverse end.

8. The cement or concrete container of claim 6 wherein the container depth is a maximum of 12 inches at one lateral end and 14 inches at the opposite lateral end.

* * * * *